US007292197B2

(12) United States Patent
Goldberg et al.

(10) Patent No.: US 7,292,197 B2
(45) Date of Patent: Nov. 6, 2007

(54) MICROSTRIP LOG-PERIODIC ANTENNA ARRAY HAVING GROUNDED SEMI-COPLANAR WAVEGUIDE-TO-MICROSTRIP LINE TRANSITION

(75) Inventors: Mark Russell Goldberg, Simi Valley, CA (US); Harold Kregg Hunsberger, Simi Valley, CA (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

(21) Appl. No.: 11/163,119

(22) Filed: Oct. 5, 2005

(65) Prior Publication Data

US 2007/0103376 A1 May 10, 2007

Related U.S. Application Data

(60) Provisional application No. 60/617,454, filed on Oct. 8, 2004.

(51) Int. Cl.

| | |
|---|---|
| ***H01Q 11/10*** | (2006.01) |
| ***H01Q 21/00*** | (2006.01) |
| ***H01Q 13/10*** | (2006.01) |
| ***H01Q 1/38*** | (2006.01) |

(52) U.S. Cl. ..... 343/792.5; 343/725; 343/770; 343/700 MS

(58) Field of Classification Search ..... 343/792.5, 343/725, 770, 700 MS

See application file for complete search history.

(56) References Cited

U.S. PATENT DOCUMENTS 3,369,243 A * 2/1968 Greiser ..... 343/770
3,696,438 A * 10/1972 Ingerson ..... 343/792.5
4,594,595 A * 6/1986 Struckman ..... 343/770
6,703,975 B1 3/2004 Freeman

OTHER PUBLICATIONS

Richard C. Johnson, "Antenna Engineering Handbook", 1993, pp. 14-32 to 14-53, Third Edition, McGraw-Hill, Inc.

Gauthier, G. et al.: W-Band Finite Ground Coplanar Waveguide (FGCPW) to Microstrip Line Transition.In:IEEE Microwave Digital Archive 1953-2000, 1998 IEEE, [CD-ROM]. Ref. No. 0-7803-4471-5/98

Wiatr, W.: Coplanar-Waveguide-To-Microstrip Transition Model. In : IEEE Microwave Digital Archive 1953-2000, 2000 IEEE, [CD-ROM]. Ref. No. 0-7803-5135-X/00.

Ellis, T. et al.:A Wideband CPW-to-Microstrip Transition For Millimeter-Wave Packaging. In: IEEE Microwave Digital Archive 1953-2000, 1999 IEEE,[CD-ROM]. Ref. No. 0-7803-5135-5/99.

Godshalk, E. et al.: Charaterization Of Surface Mount Packages At Microwave Frequencies Using Wafer Probes. In : IEEE Microwave Digital Archive 1953-2000, 2000 IEEE, [CD-ROM]. Ref. No. 0-7803-5687-X/00.

Raskin, J., Mode Conversion at GCPW-to- Microstrip-Line Transitions, IEEE, Jan. 2000, pp. 158-160, vol. 48, No. 1, Ref. No. 0018-9480/00.

* cited by examiner

*Primary Examiner*—Hoang V. Nguyen
*Assistant Examiner*—Robert Karacsony
(74) *Attorney, Agent, or Firm*—Michael Blaine Brooks, PC; Michael B. Brooks; Joseph Walkowski

(57) ABSTRACT

A log-periodic antenna having a layer of dielectric media interposed between a microstrip log-periodic portion and a slot log-periodic portion is described. Also described are antenna embodiments having a curvilinear, electrically conductive feed line and a substantially co-extensive curvilinear slot transmission line and additional embodiments including an array of two or more log-periodic antennas.

20 Claims, 11 Drawing Sheets

MICROSTRIP LOG-PERIODIC ANTENNA ARRAY HAVING GROUNDED SEMI-COPLANAR WAVEGUIDE-TO-MICROSTRIP LINE TRANSITION

CROSS-REFERENCE TO RELATED APPLICATION

This application claims the benefit of U.S. Provisional Application Ser. No. 60/617,454 filed Oct. 8, 2004, to Mark Russell Goldberg and Harold Kregg Hunsberger, entitled "MICROSTRIP LOG PERIODIC ANTENNA ARRAY HAVING GROUNDED WAVEGUIDE-TO-MICRO-STRIP LINE TRANSITION", which is hereby incorporated herein by reference in its entirety for all purposes.

BACKGROUND

The present invention, in several embodiments, relates to microstrip log-periodic antennas and, more particularly, to semi-coplanar microstrip/slot log-periodic antennas and coplanar waveguide-to-microstrip line transitions.

Log-periodic antennas are typically characterized as having logarithmic-periodic, electrically conducting, elements that may receive and/or transmit communication signals where the relative dimensions of each dipole antenna element and the spacing between elements are logarithmically related to the frequency range over which the antenna operates. Log-periodic dipole antennas may be fabricated using printed circuit boards where the elements of the antenna are fabricated in, conformal to, or on, a surface layer of an insulating substrate. The antenna elements are typically formed on a common plane of a substrate such that the principal beam axis, or direction of travel for the phase centers for increasing frequency of the antenna, is in the same direction.

SUMMARY OF THE INVENTION

The invention in its several embodiments includes a log-periodic antenna having a dielectric medium such as a printed circuit board interposed between a microstrip log-periodic portion and a proximate slot log-periodic portion where the perimeter of microstrip log-periodic portion is undersized relative to the perimeter of the first slot log-periodic antenna portion and where a proximate distance between the outer perimeter of the first microstrip log-periodic antenna portion and the perimeter of the first slot log-periodic antenna portion, perpendicular to the second surface, bound a first impedance gap. The invention in its several embodiments may further include an antenna having a curvilinear, electrically conductive feed line and a substantially co-extensive curvilinear slot transmission line. Embodiments of the invention may further include an array of two or more log-periodic antennas mounted in alternating of travel for phase center versus frequency orientations.

BRIEF DESCRIPTION OF THE DRAWINGS

For a more complete understanding of the present invention in its several embodiments, and for further features and advantages, reference is now made to the following description taken in conjunction with the accompanying drawings, in which.

DETAILED DESCRIPTION

Figure 1:
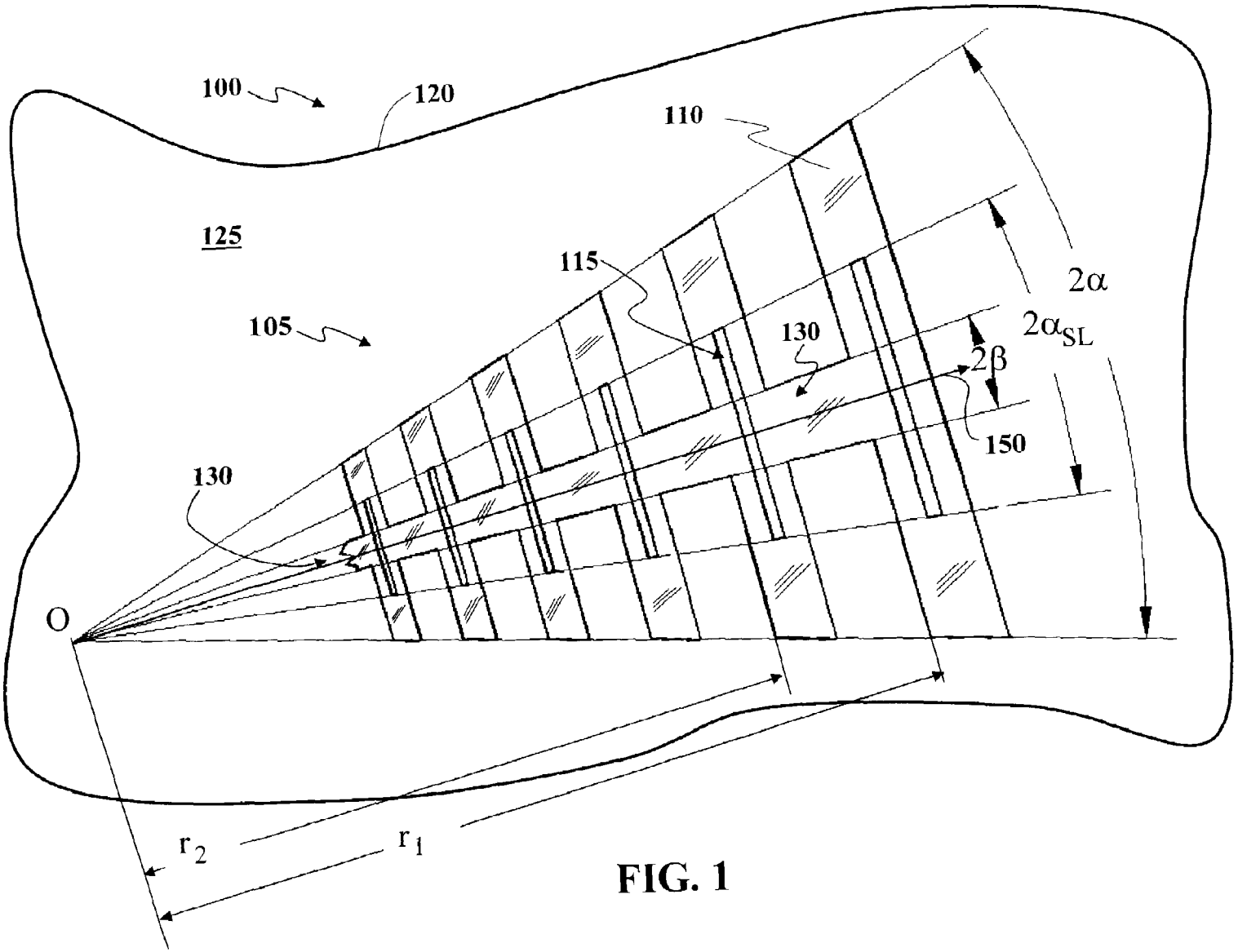
FIG. 1 illustrates in plan view an example element of the printed circuit and transmission line characteristics of the microstrip line log-periodic array feed side of the present invention.

The present invention, in its several embodiments, includes a log-periodic antenna having microstrip slot elements on a first, or top, side of a dielectric medium and a slot ground plane of the elements on a second, or bottom, side of the dielectric medium, where the radiating elements are oriented with alternating and opposing phases, e.g., 180 degrees phase differences, and where the combination may operate as a broadband log-periodic antenna. In addition, the present invention in its several embodiments may have a grounded modified semi-coplanar waveguide-to-microstrip line transition. The feed input of some embodiments typically has a transition from an unbalanced microstrip transmission line and may have a microstrip feed transmission line tapering from a base microstrip slot dipole element on a top side of the dielectric medium and a slotted ground plane under the transmission line tapering from the primary slot dipole element in a ground plane medium on the bottom side of the dielectric medium. Exemplary embodiments of the microstrip transmission line have a primary conductor strip in voltage opposition to a reference ground plane with an interceding dielectric between the two conductors. For example, the element embodiment may be fed by two slot lines in parallel that have as a common potential a main conductor. The main conductor typically tapers to a width that sets the impedance of the microstrip transmission line and along the same length, a void or slot in the ground plane is tapered to a zero width or corner point. In some embodiments, these tapered regions operate to transition the field line from being substantially between the microstrip conductor and the ground plane as in a capacitor, to being substantially fringing fields between the edges of the conductors passing through the dielectric.

Exemplary array embodiments of the present invention typically include an array of at least a pair of substantially frequency-independent planar antenna array elements where the first member of the pair of antenna array elements has a phase center travel axis substantially opposite in direction to the phase center travel axis of the second member of the pair of antenna array elements. The antenna element patterns may be aligned, i.e., top plan-form relative to bottom plan-form, which forms a microstrip log-periodic array (MSLPA) having a principal axis. Each MSLPA typically includes a slot transmission line running along the principal axis of the MSLPA that may function as feeds for the slot dipole elements, typically trapezoidal elements emanating in bilateral symmetry from the transmission line. In some embodiments, parasitic, or center, microstrip lines or slots may be interposed within the regions formed by the dipole elements and the transmission line of the combined layers. The outer perimeter of the feed side of the MSLPA typically describes a pattern or plan-form, the ground plane side of the log-periodic slot array typically then covers a pattern of the perimeter of each feed side microstrip line element of the top side and along with some additional width at an orientation substantially perpendicular to the perimeter to establish an impedance slot.

FIG. 1 illustrates an exemplary microstrip dipole element array and transmission line characteristics of a microstrip log-periodic array embodiment 100 of the present invention that is typically affixed on a first or top surface 125, or front side, of a dielectric medium 120 such as a printed circuit board. The transmission line portion 130 of the exemplary array is within the region subtended by the angle $2\beta$. The log-periodic array of the exemplary embodiment is typically symmetric in a plane about a principal axis 150 where the dipole elements extend as trapezoidal portions bounded in this example by the angle $2\alpha$. Generally, an internal centered slot 115 is provided by the pattern of the microstrip line at each element and may cross or traverse the transmission line portion 130. The pattern of the microstrip portion 105 of the MSLPA 100 may be a thin metallic film and the internal centered slot 115 may be fashioned by a trapezoidal region absent of the metallic film. The transverse extent of each interior slot in this example is bounded by the angle $2\alpha_{SL}$. For purposes of illustrating the proportions of the microstrip elements of the antenna, the dipole elements, or dipole teeth of the array that may traverse the transmission line portion are numbered starting with the dipole of largest wavelength. For example, the first dipole 110 is shown with the longest span, i.e., the longest portion traversing the transmission line portion 130. The exemplary minimal radial distance from the reference origin, O, for the microstrip portion of the first dipole element may be represented as $r_1$ and the minimal radial distance for the second dipole element may be represented as $r_2$.

Figure 2:
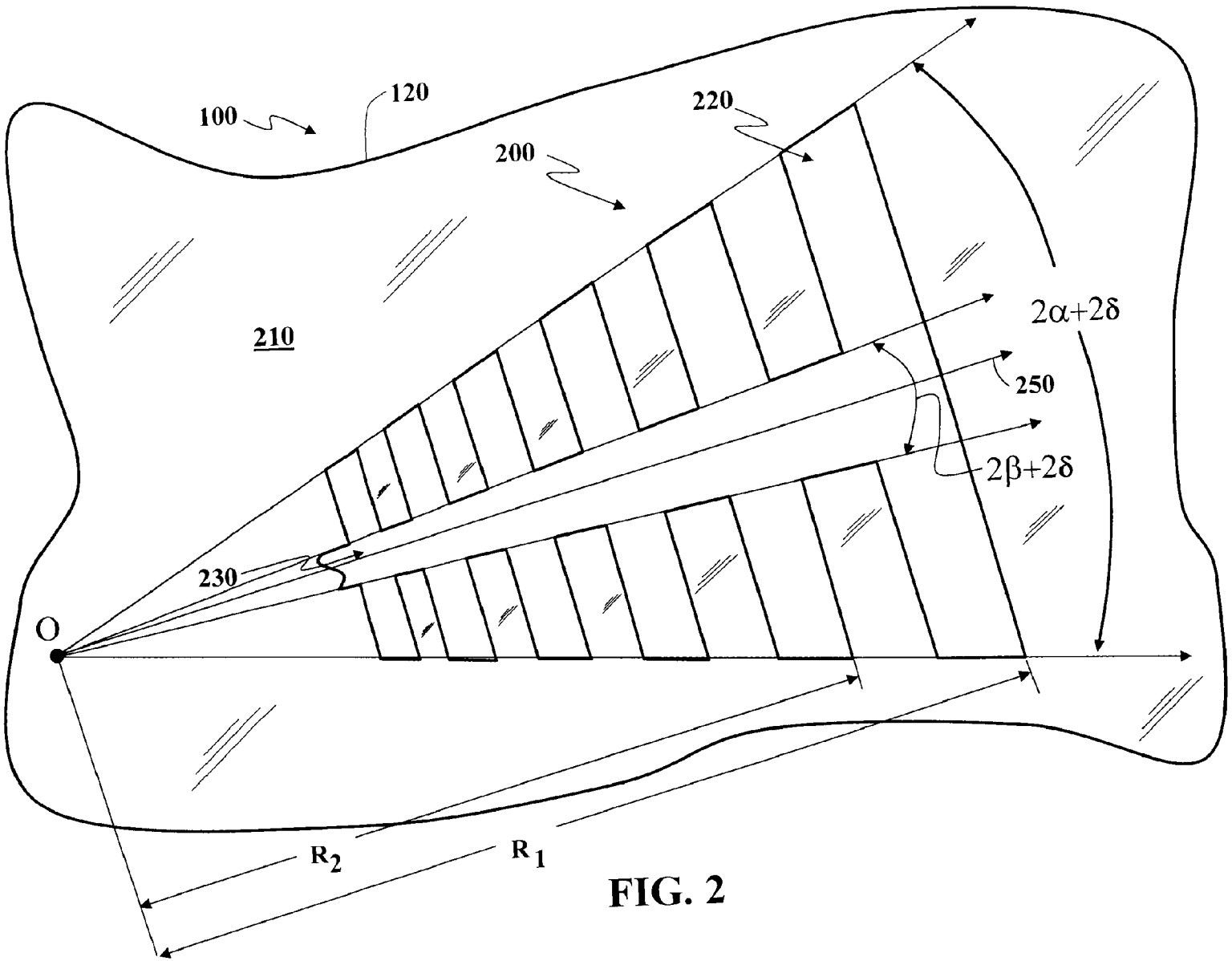
FIG. 2 illustrates in plan view an example of the ground side of the log-periodic slot array of the present invention.

FIG. 2 illustrates an exemplary ground plane side 210 of the microstrip log-periodic slot array (MLPSA) 100 of the present invention where a slot log-periodic antenna portion 200 may be typically formed from a metallic ground plane which may be applied as the bottom or second surface, of the interposed medium such as a printed circuit board, and may form the back, bottom or opposite side, of the printed circuit board, i.e., opposite the feed side where the microstrip portion 105 of the MLSPA 100 is affixed. The feeder transmission line portion of the array is within the region that may be shown as subtended by the angle $2\beta$ plus twice the planar slot width, shown as a small angle, $\delta$, and typically a distance perpendicular to the local perimeter, w (not shown in FIG. 2). The slot width is typically adjusted in the matching of the impedance of the array of elements, both the microstrip elements and the slot elements of the ground plane, and including the interposed printed circuit board or other mounting media. Typically, the log-periodic array of the present invention is substantially symmetric in plane about a principal axis 250 where the slot dipole elements traverse a slot transmission line 230 and extend as trapezoids bounded by the angle $2\alpha$ plus twice the slot width, w, represented as a small angle, $2\delta$, as above.

For purposes of illustrating the slot portions of the MLPSA 200, the elements of the array are numbered starting with the slot dipole element of largest wavelength 220, that is, the element having the exemplary largest transverse span. The maximal radial distance from the reference origin, O, for the first dipole may be represented as $R_1$. The maximal radial distance from the reference origin, O, for the second dipole may be represented as $R_2$. The minimal distance from the reference origin, O, for the first dipole may be represented as $r_1$ less the impedance slot width. A similar relationship may be made for $R_2$ and $r_2$. Typically, the feeder transmission line angle of the microstrip, or top portion $2\beta$ is smaller than the angle of $2\beta$ plus the angle increment, e.g., $2\delta$, required for impedance slot with of the ground side of the dielectric medium, and likewise the angle $2\alpha$ bottom plus the angle increments $2\delta$ of the ground side required for impedance slot width is greater than $2\alpha$ of the top side. Rather than expressed by the angle, $\delta$, this may be expressed as the linear distance, w, when viewing the planar projections of the microstrip dipole elements and the slot dipole elements in plan view.

Figure 3A:
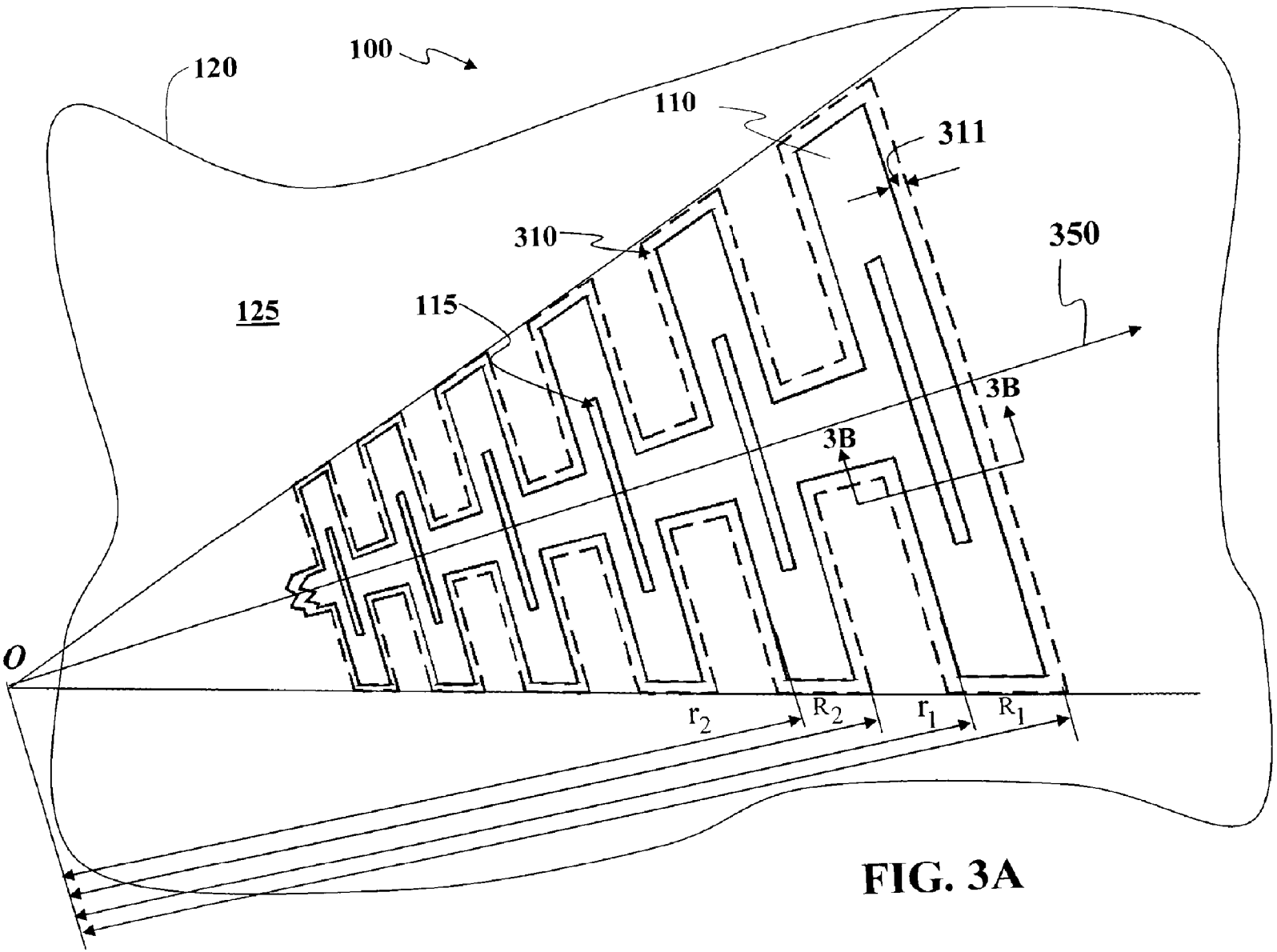
FIG. 3A illustrates in a plan view an example of six elements in the example array of the microstrip log-periodic feed side of the slot array aligned with the log-periodic ground side of the slot array.

For each exemplary pair of top and bottom trapezoidal dipole elements, an impedance slot may be created as shown in the top view of the antenna of FIG. 3A, where FIG. 3A illustrates in a top view an exemplary array of the MSLPA showing six element pairs and where the impedance slot is shown in the space 310 between the microstrip and the ground plane having, in a projection made substantially perpendicular to the local surface and through the interposed dielectric media 120, the slot width 311, w. In this exemplary array of the MSLPA, the top and bottom sides are overlaid, where the dashed lines indicate the boundary or slot perimeter of the ground-side present on the bottom side of the dielectric medium. Accordingly, in an exemplary embodiment, the MSLPA is affixed to the dielectric medium such as a printed circuit board (PCB) in an orientation such that the edges of the ground plane side of the slots of the MLPSA generally provide for an outer perimeter. Put another way, the perimeter of the slot portion is oversized relative to the perimeter of the microstrip portion and the perimeter of the microstrip portion is undersized relative to the slot portion.

Figure 3B:
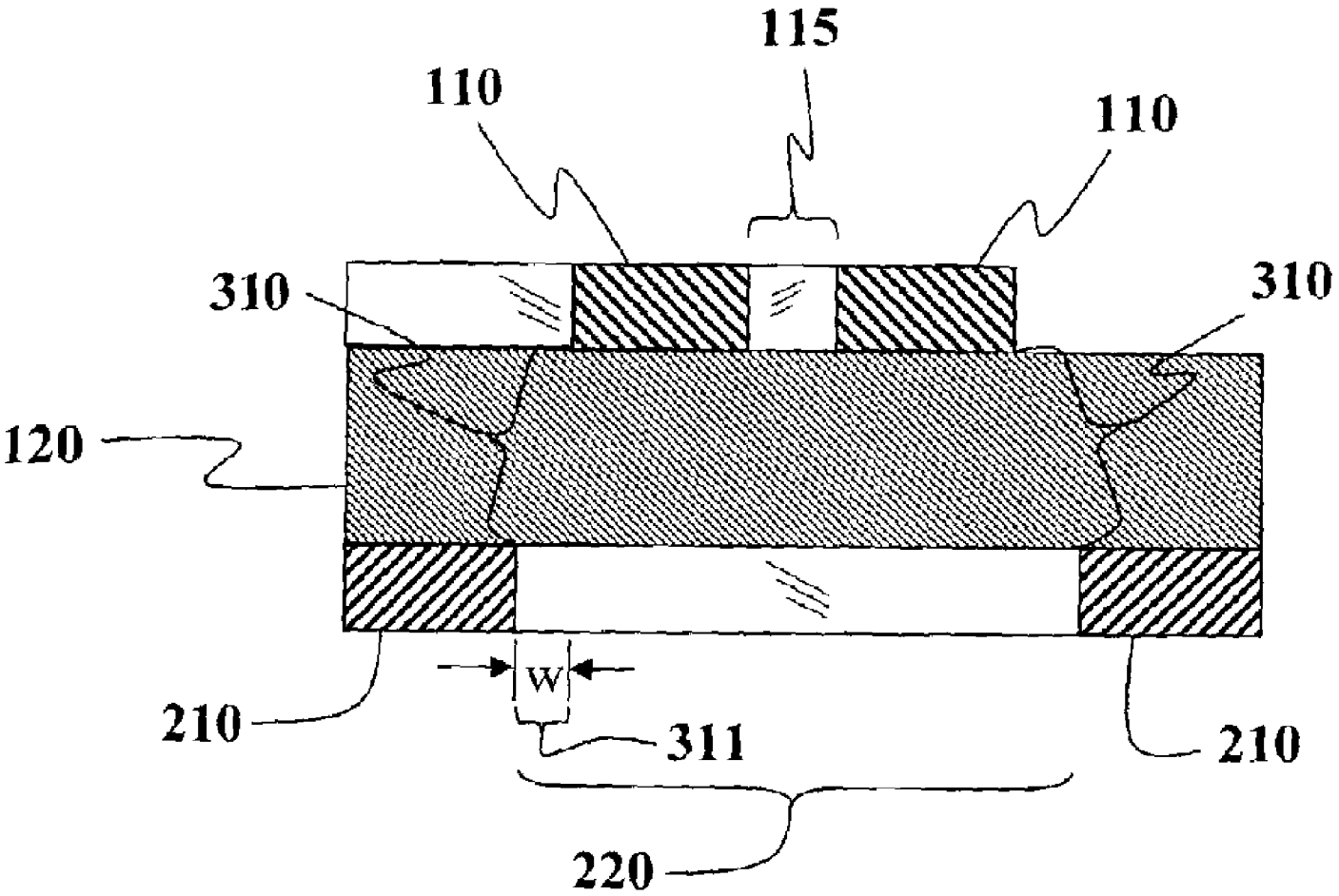
FIG. 3B illustrates in a cross-sectional view an example of an element in the example array of the microstrip log-periodic feed side of the slot array aligned with the log-periodic ground side of the slot array.

FIG. 3B illustrates in cross-sectional view the microstrip portion 110 of an element in relation to a ground plane portion 210 and an interposed PCB as an example of a dielectric medium 120. In this view (FIG. 3B), an internal centered slot 115 may be seen in cross-section as well as a slot element 220 of the MLPSA. Also illustrated in cross-sectional view of FIG. 3B, the impedance slot is shown in the space 310 between the microstrip and the ground plane having, in a planar projection, the slot width 311, w. The resulting stacked MSLPA is operable to function as a substantially frequency-independent antenna having a traversing of its phase center with respect to frequency substantially along the line of bilateral symmetry 350 (FIG. 3A).

Another antenna embodiment is described as follows where w represents the planar width of the impedance slot, $\tau$ represents the element expansion ratio, and $\epsilon$ represents a measure of tooth width in the following equations:

$$\tau=R_{n+1}/R_n=r_{n+1}/r_n \quad [1]$$

and $$\epsilon=r_n/R_n. \quad [2]$$

The "over angle" subtended by the completed antenna may be represented as $2\alpha+2\delta$. Exemplary relationships include an $\epsilon$ of $\sqrt{\tau}$, a $\beta$ of $\alpha_{SL}/3$, and an $\alpha_{SL}$ of $(\alpha+\delta)/2$.

Exemplary antenna array properties include a value for an over angle, or $2\alpha+2\delta$ of approximately 36 degrees, a value for $2\alpha$ of approximately 33 degrees, a value for $2\alpha_{SL}$ of approximately 18 degrees, and a value for $2\beta$ of approximately 6 degrees.

Exemplary antenna array properties are illustrated in Table 1 with distances in inches for dipole teeth numbered 1-19:

TABLE 1

Exemplary Antenna Properties

| R | r | T | $\epsilon$ | W | # |
|---|---|---|---|---|---|
| 5.500 | 4.980 | 0.82 | 0.91 | 0.0866 | 1 |
| 4.510 | 4.084 | 0.82 | 0.91 | 0.0710 | 2 |
| 3.698 | 3.349 | 0.82 | 0.91 | 0.0582 | 3 |
| 3.033 | 2.746 | 0.82 | 0.91 | 0.0477 | 4 |
| 2.487 | 2.252 | 0.82 | 0.91 | 0.0391 | 5 |
| 2.039 | 1.846 | 0.82 | 0.91 | 0.0321 | 6 |
| 1.672 | 1.514 | 0.82 | 0.91 | 0.0263 | 7 |
| 1.371 | 1.242 | 0.82 | 0.91 | 0.0216 | 8 |
| 1.124 | 1.018 | 0.82 | 0.91 | 0.0177 | 9 |
| 0.922 | 0.835 | 0.82 | 0.91 | 0.0145 | 10 |
| 0.756 | 0.685 | 0.82 | 0.91 | 0.0119 | 11 |
| 0.620 | 0.561 | 0.82 | 0.91 | 0.0098 | 12 |
| 0.508 | 0.460 | 0.82 | 0.91 | 0.0080 | 13 |
| 0.417 | 0.377 | 0.82 | 0.91 | 0.0066 | 14 |
| 0.342 | 0.310 | 0.82 | 0.91 | 0.0065 | 15 |
| 0.280 | 0.254 | 0.82 | 0.91 | 0.0053 | 16 |
| 0.230 | 0.202 | 0.77 | 0.88 | 0.0047 | 17 |
| 0.177 | 0.155 | 0.77 | 0.88 | 0.0036 | 18 |
| 0.136 | 0.120 | 0.77 | 0.88 | 0.0028 | 19 |

The present invention, in its several embodiments, typically has the antenna structurally divided into two portions on either side of a mounting medium such as a two-sided PCB. The two-sided printed circuit board embodiment accommodates the exemplary feed described below. That is, the feed transition from microstrip to the radiating elements may be fabricated with a dielectric medium such as a two-sided printed circuit board and a tapered ground. In addition to the various feed embodiments, the two-sided PCB structure and material provide additional means by which the antenna impedance of the several antenna embodiments may be controlled, for example, by variation of material thickness and by selection of the dielectric constant of the PCB. Due to the field constraint within the dielectric material, high power, high frequency alternative embodiments of the present invention may exploit the increased breakdown characteristics of the higher frequency, i.e., the smaller wavelength, portion of the antennas.

Figure 4:
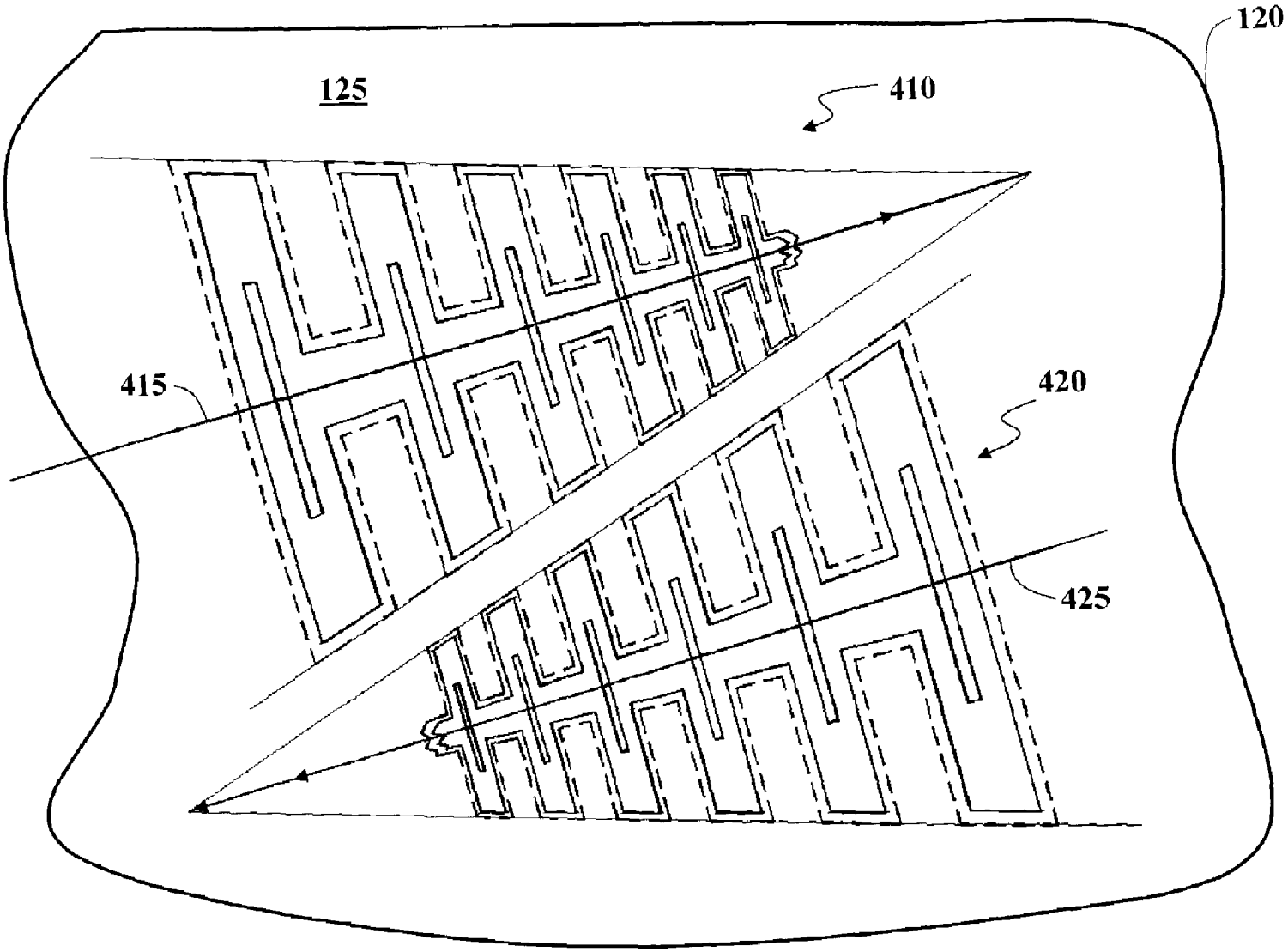
FIG. 4 illustrates in plan view an exemplary, typical placement of two antenna elements of the present invention proximate to one another and oriented so that each has a traveling phase center verses frequency opposite the other.

FIG. 4 illustrates an exemplary placement of two microstrip, log-periodic arrays of an embodiment of the present invention that are proximate to one another and oriented so that the phase center travel 415 of a first antenna 410 is substantially opposite the phase center travel 425 of the second antenna 420 and may receive or transmit substantially as a single combined antenna element. These opposing phase center travel directions are typically offset, which may adapt these combined elements to the direction finding of targets out of the plane of the elements; that is, receiving RF energy at angles of arrival substantially off the axes 415 and 425 of the opposing traveling phase centers.

Figure 5A:
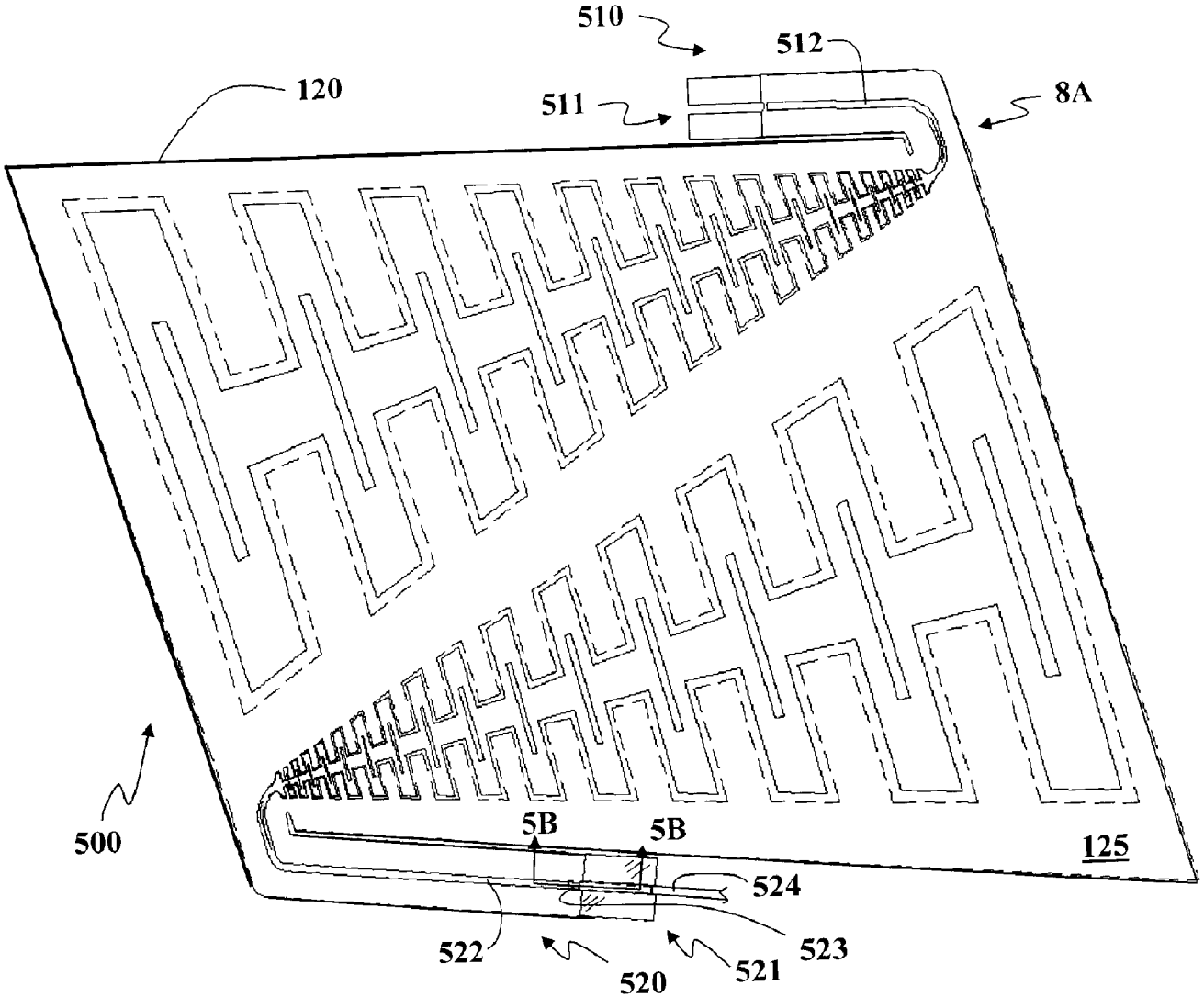
FIG. 5A illustrates in plan view a exemplary, typical embodiment where a printed circuit board has two microstrip log-periodic array feeds on a top side and their corresponding aligned ground planes on the opposite side of the printed circuit board.
Figure 5B:
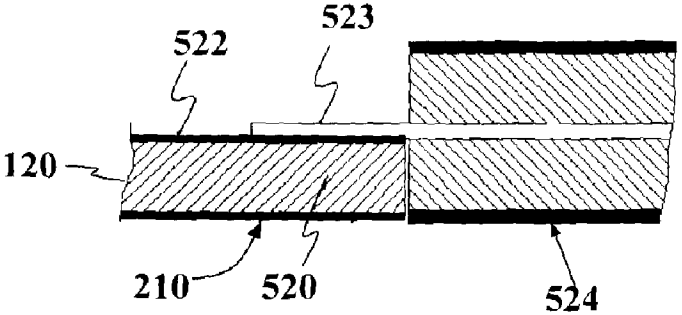
FIG. 5B illustrates in a cross-sectional view the fork region of a tongue of an embodiment engaging a coax inner wire.

FIG. 5A illustrates an exemplary embodiment where the PCB has two MSLPAs with their feeds on the illustrated upper surface, or top side, and their corresponding aligned ground planes on the opposite surface, or bottom side, of the PCB where each form an antenna and together form an antenna array on the PCB. FIG. 5A illustrates exemplary feed tongues 510 and a second feed tongue 520, i.e., one for each antenna. For example, the inner wire or conductor 523 of a coaxial feed line, once within the fork 511 or 521 of each feed tongue, may be soldered or otherwise put in electrical connectivity with the microstrip feed line 512, 522 and soldered or otherwise put in electrical connectivity with the ground plane. As illustrated by FIG. 5B, a cross-sectional view of FIG. 5A at the second tongue 520, typically, the outer conductor 524 of the coaxial conductor may also have direct current (DC) connectivity with the ground plane 210, which is shown by example as being on the bottom side of the PCB 120, and the inner wire 523 also typically has connectivity with the microstrip feed line 522 which is shown by example as being on the top side of the PCB 120. Further detail of the planar projection of the perimeter of an exemplary curvilinear portion of the microstrip feed line relative to the planar projection of the perimeter of an exemplary curvilinear, tapered ground transition is described below and illustrated in FIG. 8A.

Mounting

Figure 6:
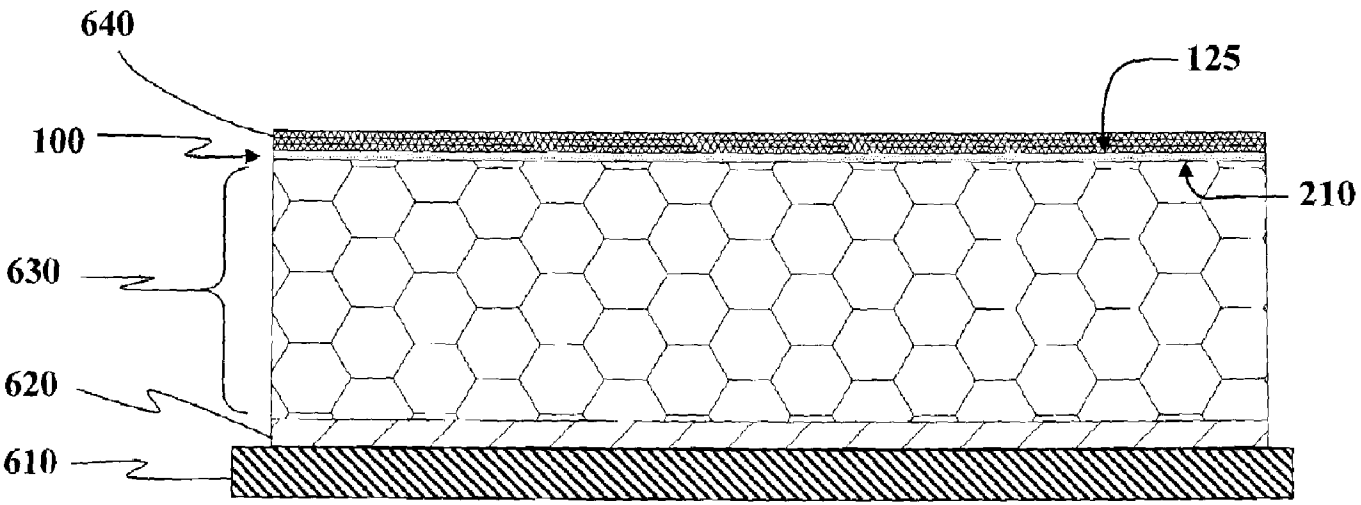
FIG. 6 illustrates in a cross-sectional view an exemplary mounting.

The antenna array elements of the several embodiments may be mounted above a grounded cavity, or other receiving element, that provides both grounding and feed lines such as the coaxial conductor example described above. Illustrated in FIG. 6 is an exemplary cavity having a bottom surface 610 that may be formed of metal, e.g., steel, titanium, or aluminum or various metal alloys, where a radio frequency absorber element 620, or sheet, may be interposed between the cavity surface and the bottom side such as the ground plane 210 of the antenna array elements. In addition, a low dielectric material deployed as foam or a honeycomb-type element 630 that may be interposed between the radio frequency absorber element and the bottom side 210 of the antenna array elements.

The antenna array element 100, an absorber layer element 620, and a low dielectric element and the antenna array element may be bonded together. For environmentally challenging environments such as for example those encountered in moisture laden atmosphere with high dynamic pressures experienced at supersonic velocities, a cover 640, skin, or radome may be used to shield, or protect, or otherwise cover all or a portion of the top 125 or outwardly directed portion of the antenna array element, a covered portion that may include the top side 125 of the dielectric material 120, thereby covering a region that could or would otherwise be in direct environmental contact with free space, for example. The microstrip line array of the top side and the ground plane slots of the bottom side of the array may be fabricated on a low loss, low dielectric substrate, e.g., RT5880 DUROID™, a substrate available from Rogers Corporation, Advanced Circuit Materials, of Chandler, Ariz., or may be fabricated of equivalently low dielectric materials at thickness of around 15 mils, for example. Other thickness ranges may be used depending on the properties of the low dielectric material and the desired gap 310 (FIG. 3B). In addition, a cavity resonance absorber such as a flexible, ferrite-loaded, electrically non-conductive silicone sheet may be applied within a cavity mounting. Where the cavity is formed of metal or has a metalized or electrically conductive surface, the antenna array may be in electrical contact with the cavity surface where the cavity surface may serve as the base ground plane of the antenna array. In addition, the two-sided PCB embodiments of the array may provide the ability to control, by selection, the impedance by selecting from variations of PCB material thickness and their respective dielectric constants.

The substantially planar profile of the antenna array may exhibit some curvature and, whether flat or contoured, may be conformally mounted. In those geometries requiring conformal mounting about a radius of curvature, the transverse edges of the otherwise typically trapezoidal dipole elements are themselves typically curved to accommodate a curved printed circuit board surface that may then conform to a selected mounting geometry.

The several embodiments of the invention have gain and pattern properties, which are typically robust with respect to the effect of cavity depth on the elements. For example a cavity with an absorber-lined bottom surface and metal back negligibly affects the antenna gain and pattern properties where cavity depth is at a minimum of 0.1 lambda, i.e., one-tenth of a wavelength of the frequency in question. Put another way, the exemplary embodiments may be configured to experience a slight loss of antenna gain or antenna gain-angle pattern distortion for cavities shorter than one-tenth lambda with a corresponding change in the input voltage standing wave ratio (VSWR).

Microstrip Feed Structure

Some high power, high frequency applications of the several embodiments may experience an increase in the breakdown characteristics of the high frequency portion of the elements. The exemplary feed structure embodiments readily accommodate elements operating from frequencies below X-band through well into the Ka-band. In order to accommodate structures into the upper Ka-band, micro-etching techniques are typically applied. At these higher frequencies, material thicknesses are typically reduced from those accommodating X-band antenna embodiments.

Figure 7:
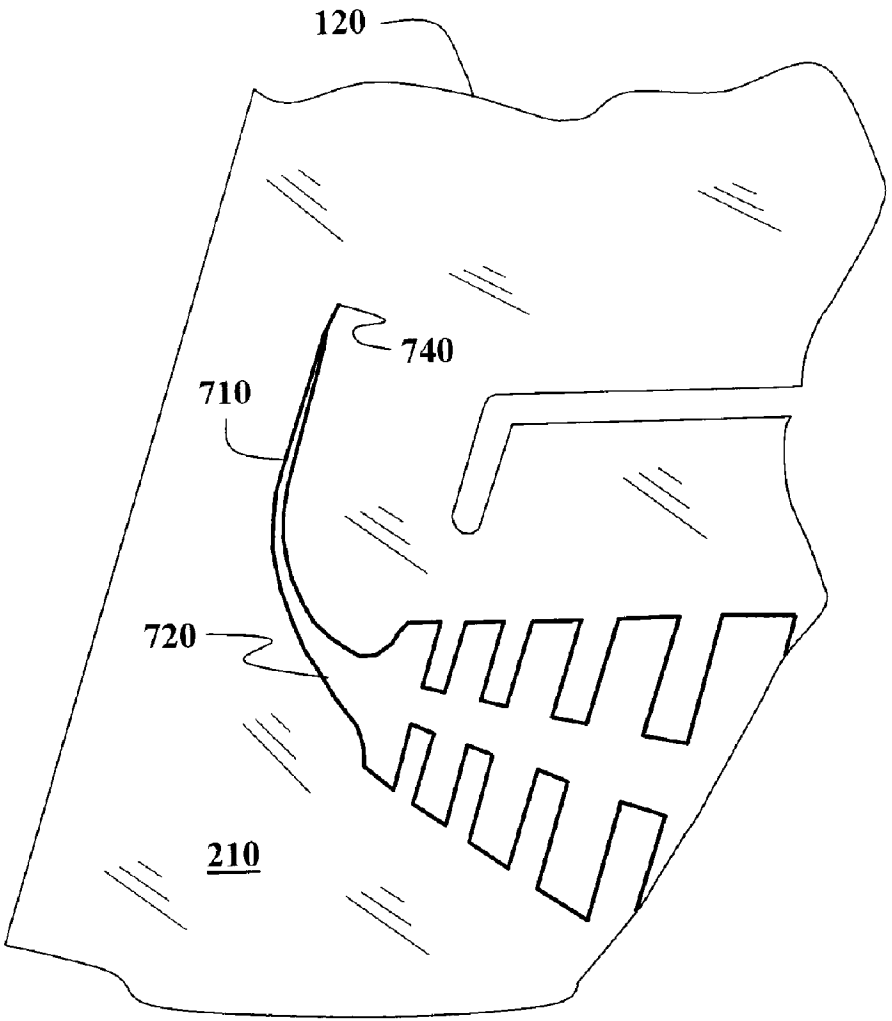
FIG. 7 illustrates in plan view an exemplary curved taper in the grounded side of the exemplary microstrip log-periodic array from the last element to the ground plane.

Each of the antenna array elements typically includes a microstrip feed structure that splits and feeds to the two-sided antenna array element. Some embodiments of the feed structure combine microstrip feed lines with a tapered ground transition and the two-sided antenna element. Typically the feed structure includes a microstrip feed line having a tapered ground transition. FIG. 7 illustrates an exemplary curvilinear, tapered ground transition 710 from the last element (e.g. a high or highest frequency element) of the MSLPA. The transition from the last slot element 720 to the feed transmission line is tapered in this exemplary fashion in part to minimize VSWR effects and to continue the transition from microstrip to the antenna element. The feed transmission line is tapered in this exemplary embodiment to a point 740. In addition, the base of the slot feed transmission line taper may curve in the direction of the exemplary feed-line tongue 510, 520 to minimize sharp angles that may otherwise set up what may be undesired or parasitic active portions.

Figure 8B:
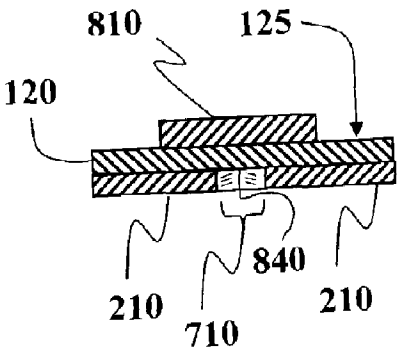
FIG. 8B illustrates in cross-sectional view an exemplary microstrip feed line as it curves from the feed-line tongue to the base of the exemplary microstrip log-periodic array.
Figure 8A:
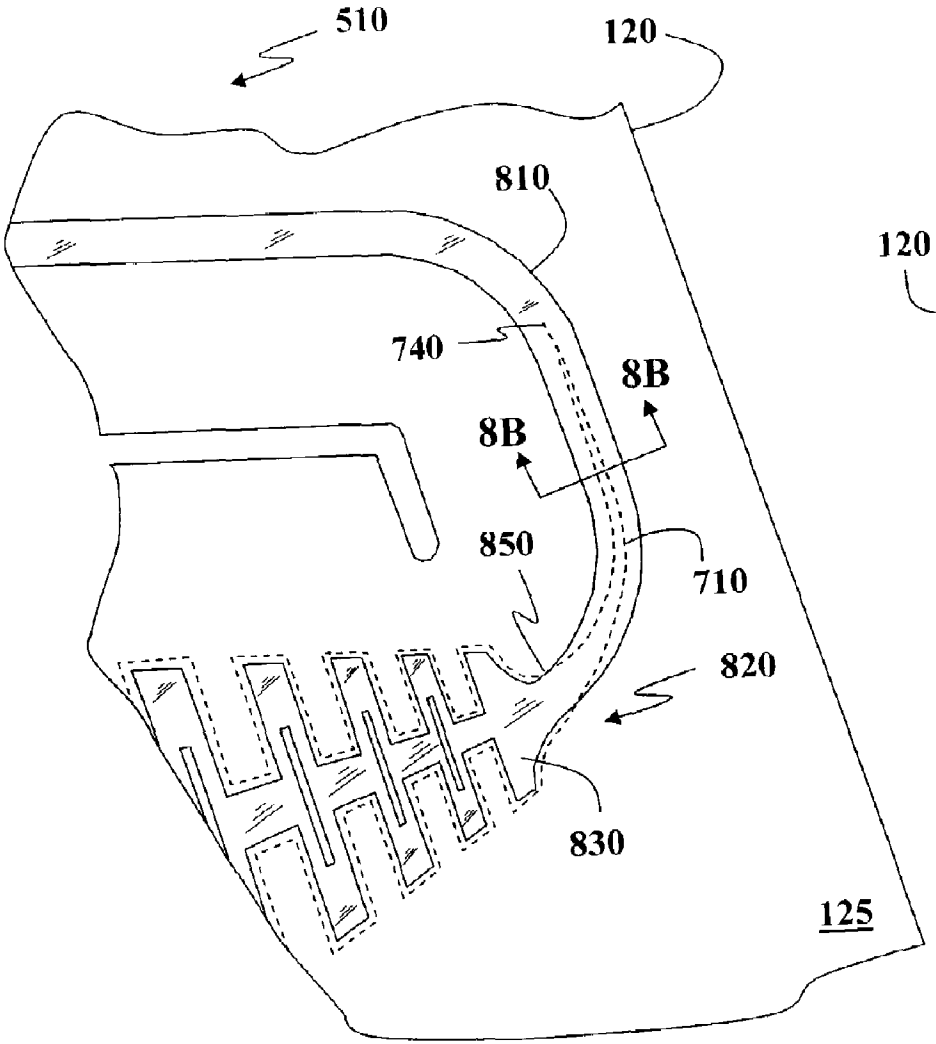
FIG. 8A illustrates in plan view an exemplary microstrip feed line as it curves from the feed-line tongue to the base of the exemplary microstrip log-periodic array.

FIG. 8A illustrates the exemplary microstrip feed line 810 as it curves from the feed line tongue 510 to the base of the MSLPA 820 where the feed line flares out to the last element of the MSLPA. The last element 830 is tapered in this example in part to minimize feed point radiation and prevent the last element from arraying with the proximate element to form a radiating beam for this section and accordingly improve input matching over base elements lacking a tapered feed line. The tapering, or decreasing width, of the transition from the last slot element 720 to the slot feed transmission line 710 may cause the slot width or perimeter of the slot feed transmission line, in a planar projection made perpendicular or substantially perpendicular to the surface or local surface regions of the dielectric medium 120 to which the slotted ground plane 210 is attached, to fall within, as depicted at 850, the plan form of the exemplary microstrip feed line 810 that is to be within a projection of the perimeter of the microstrip feed line 810 made perpendicular to the surface or local surface regions of the dielectric medium 120 to which the microstrip feed line 810 is attached. The last element in these exemplary embodiments typically does not have a parasitic slot within its perimeter. Also shown in this view is the relative orientation of the exemplary microstrip feed line 810 and the curvilinear, tapered ground transition 710 along with its exemplary tip ending 740 that, in a planar projection made planar to the local surface, is within the plan form, or perimeter, of the exemplary microstrip feed line 810; that is, within a projection of the exemplary microstrip feed line 810 made perpendicular to the local surface. Accordingly, when viewed in plan view and projecting across the interposed dielectric medium 120, the antenna embodiments may have a curvilinear, electrically conductive feed line 810 and a substantially co-extensive curvilinear slot transmission line 710 for a portion of the run of the microstrip feed line 810. FIG. 8B illustrates in cross-sectional view, the exemplary microstrip feed line 810 as it curves from the feed line tongue 510 to the base of the MSLPA 820 where the feed line flares out to the last element of the MSLPA. Also illustrated in this view is the tapered ground transition 710 ending at the tip corner 840.

Receiving, Transmitting and Transceiving

Figure 9:
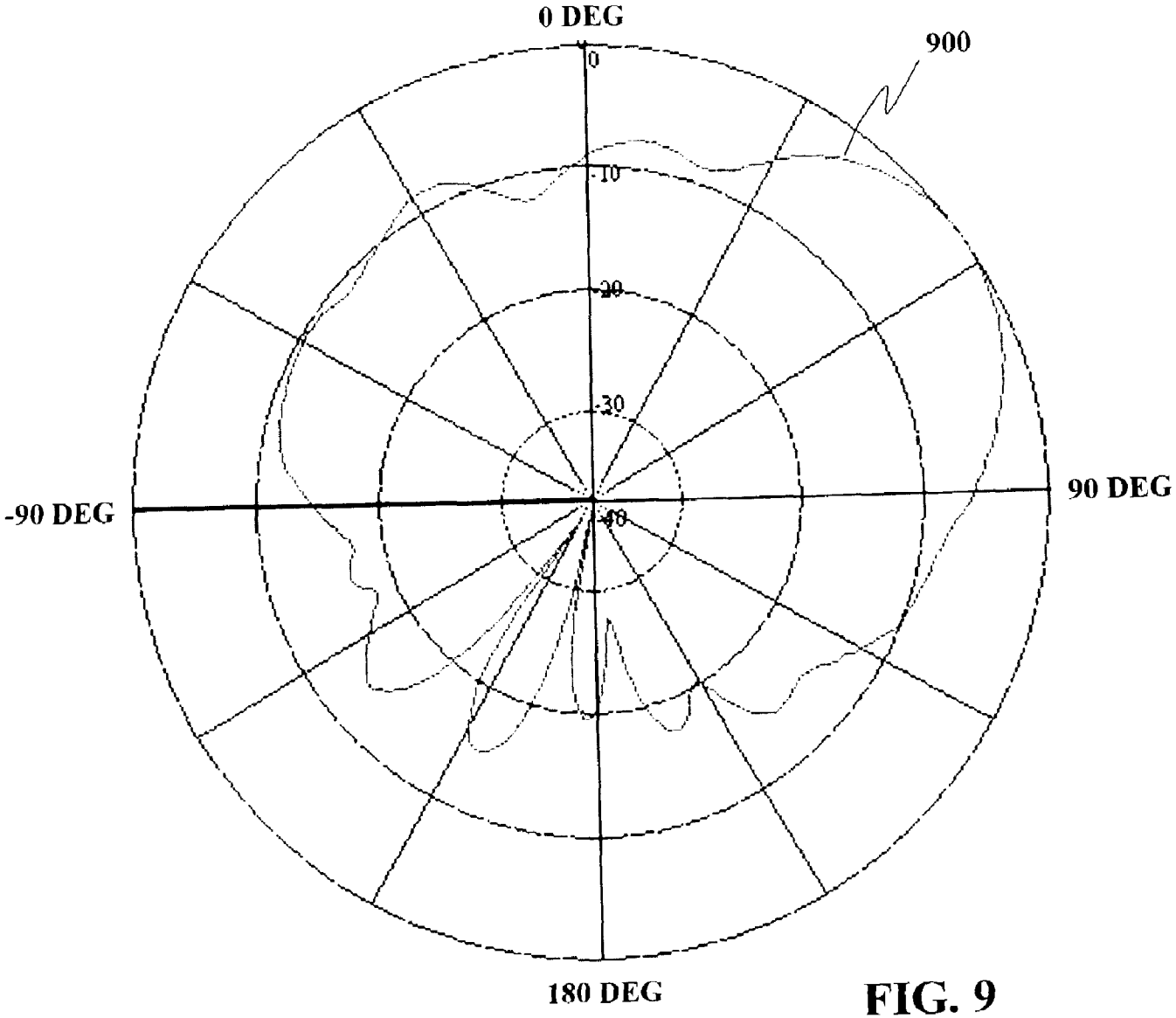
FIG. 9 illustrates an exemplary antenna gain pattern produced from measurements of an exemplary antenna taken at a low frequency.
Figure 10:
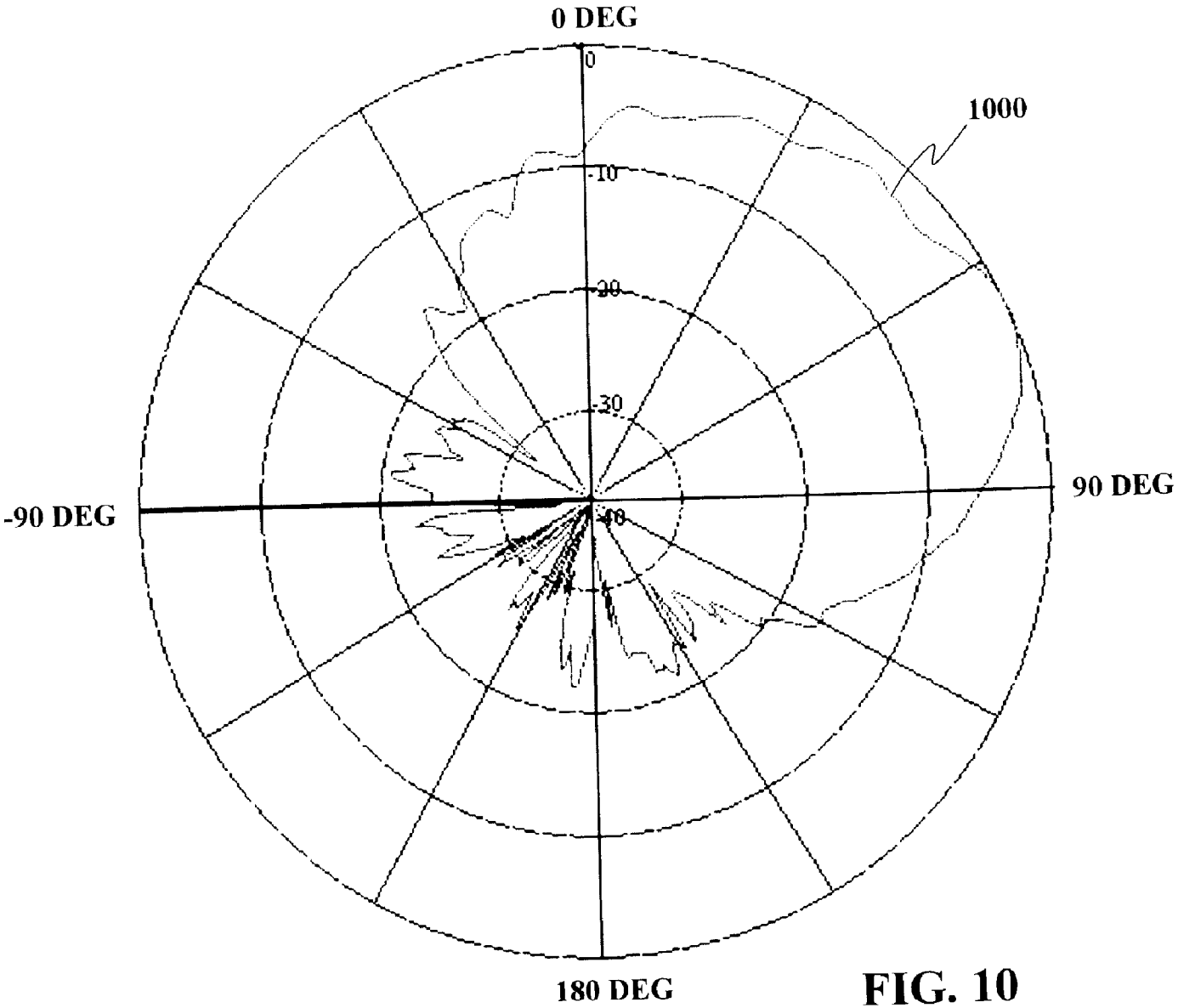
FIG. 10 illustrates an exemplary antenna gain pattern produced from measurements taken at a midrange frequency, As used herein, the term "exemplary" means by way of example and to facilitate the understanding of the reader, and does not indicate any particular preference for a particular element, feature, configuration or sequence.

The antenna array embodiments of the present invention may provide substantially constant forward directivity, typically with only subtle or otherwise operationally negligible changes in beam-width, and afford an antenna array of forward and aft facing elements of equal or nearly equal performance. For purposes of illustrating the performance of an embodiment of the present invention, the antenna array of forward-oriented and aft-oriented element arrays where the MSLPAs have fifteen trapezoidal dipole elements, i.e., teeth, and one base tapered trapezoidal dipole element were tested. FIG. 9 illustrates an antenna gain pattern 900, in dB, as a function of beam angle pattern produced from measurements taken at a low frequency, i.e., directed radio frequencies intended to excite the larger dipole elements. FIG. 10 illustrates an antenna gain pattern 1000, in dB, as a function of beam angle produced from measurements taken at a midrange frequency, i.e., directed radio frequencies intended to excite the intermediate-sized dipole elements.

Some antenna embodiments of the present invention may be used to send, receive or transceiver RF signals. Accordingly, an array of at least a pair of substantially frequency independent planar antenna array elements may function as a receiving array and may alternatively function as a transmitting array or a transmitting and receiving, that is, the array may function as a transceiver array.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims.

The definitions of the words or elements of the following claims are, therefore, defined in this specification to include not only the combination of elements which are literally set forth, but all equivalent structure, material or acts for performing substantially the same function in substantially the same way to obtain substantially the same result. In addition to the equivalents of the claimed elements, obvious substitutions now or later known to one with ordinary skill in the art are defined to be within the scope of the defined elements.

What is claimed is:

1. A log-periodic antenna comprising:

a first dielectric member having a first surface and a second surface;

a first slot log-periodic antenna portion having a perimeter, the first slot log-periodic antenna portion mounted to the second surface; and a first microstrip log-periodic antenna portion having a perimeter undersized relative to the perimeter of the first slot log-periodic antenna portion, the first microstrip log-periodic antenna portion mounted to the first surface and oriented in proximity to the first slot log-periodic antenna portion;

wherein a projection of the perimeter of the first microstrip log-periodic antenna portion, perpendicular to the first surface, and a projection of the perimeter of the first slot log periodic antenna portion, perpendicular to the second surface, bound a first impedance gap.

2. The log-periodic antenna of claim 1 wherein the first slot log-periodic antenna portion comprises a plurality of substantially trapezoidal slot dipoles, wherein the slot dipoles are substantially transverse to a slot transmission line.

3. The log-periodic antenna of claim 1 wherein the first microstrip log-periodic antenna portion comprises a plurality of substantially trapezoidal microstrip dipoles, wherein the microstrip dipoles are substantially transverse to a microstrip transmission line.

4. The log-periodic antenna of claim 3 wherein at least one of the plurality of substantially trapezoidal microstrip dipoles has a slot substantially traversing the microstrip transmission line.

5. A log-periodic antenna array comprising:

a first antenna element having a first traveling phase center versus frequency oriented in a first direction, the first antenna element comprising:

a first dielectric member having a first surface and a second surface;

a first microstrip log-periodic antenna portion mounted to the first surface, the first microstrip log-periodic antenna portion having a perimeter; and a first slot log-periodic antenna portion mounted to the second surface, the first slot log-periodic antenna portion having perimeter and oriented in proximity to the first microstrip log-periodic antenna portion wherein a projection of the perimeter of the first microstrip log-periodic antenna portion, perpendicular to the first surface, and a projection of the perimeter of the first slot log-periodic antenna portion, perpendicular to the second surface, bound a first impedance gap; and a second antenna element proximate to the first antenna element, the second antenna element having a second traveling phase center versus frequency oriented in a second direction substantially opposite the first direction, the second antenna element comprising:

a second microstrip log-periodic antenna portion mounted to the first surface, the second microstrip log-periodic antenna portion having a perimeter; and a second slot log-periodic antenna portion mounted to the second surface, the second slot log-periodic antenna portion having a perimeter and oriented in proximity to the second microstrip log-periodic antenna portion wherein a projection of the perimeter of the second microstrip log-periodic antenna portion, perpendicular to the first surface, and a projection of the perimeter of the second slot log-periodic antenna portion, perpendicular to the second surface, bound a second impedance gap.

6. The log-periodic antenna array of claim 5 wherein the first slot log-periodic antenna portion comprises a plurality of substantially trapezoidal slot dipoles, wherein the first slot dipoles are substantially transverse to a first slot transmission line and wherein the second slot log-periodic antenna portion comprises a plurality of substantial trapezoidal slot dipoles, wherein the second slot dipoles are substantially transverse to a second slot transmission line.

7. The log-periodic antenna array of claim 5 wherein the first microstrip log-periodic antenna portion comprises a first plurality of substantially trapezoidal microstrip dipoles, wherein the first microstrip dipoles are substantially transverse to a first microstrip transmission line, and wherein the second microstrip log-periodic antenna portion comprises a second plurality of substantially trapezoidal microstrip dipoles, wherein the second microstrip dipoles are substantially transverse to a second microstrip transmission line.

8. The log-periodic antenna array of claim 7 wherein at least one of the first plurality of substantially trapezoidal microstrip dipoles has a first slot substantially traversing the first microstrip transmission line and wherein at least one of the second plurality of substantially trapezoidal microstrip dipoles has a second slot substantially traversing the second microstrip transmission line.

9. A log-periodic antenna comprising:

a substantially planar dielectric substrate having a first surface and a second surface;

a first microstrip log-periodic array comprising a plurality of slot dipole elements fixed to the first surface of the substantially planar dielectric substrate, wherein the plurality of dipole elements includes a base microstrip element;

a first log-periodic slot array within a ground plane comprising a plurality of dipole elements within the ground plane, wherein the ground plane is fixed to the second surface of the substantially planar dielectric substrate, wherein the plurality of dipole elements includes a base slot element;

a first electrically conductive feed line fixed to the first surface adapted to transmit to the base microstrip element wherein the first electrically conductive feed line curvilinearly extends from the base microstrip element; and a first slot transmission line formed from a slot portion curvilinearly extending with decreasing width from the base slot element.

10. The log-periodic antenna of claim 9 wherein the first electrically conductive feed line extends with a tapered transition from the base microstrip element.

11. The log-periodic antenna of claim 9 wherein the width of a projection of a perimeter of the first slot transmission line, perpendicular to the second surface, decreases to a point within a projection of a perimeter of the first electrically conductive feed line, perpendicular to the first surface.

12. A log-periodic antenna comprising a planar slot log-periodic antenna portion in parallel proximity to a planar microstrip log-periodic antenna portion, wherein a planar dielectric medium is interposed between the slot log-periodic antenna portion and the microstrip log-periodic antenna portion.

13. A log-periodic antenna comprising:

a first dielectric member having an upper surface and a lower surface;

a first slot log-periodic antenna portion having a perimeter, the first slot log-periodic antenna portion mounted to the lower surface; and a first microstrip log-periodic antenna portion having a perimeter undersized relative to the perimeter of the first slot log-periodic antenna portion, the first microstrip log-periodic antenna portion mounted to the upper surface and oriented in proximity to the first slot log-periodic antenna portion;

wherein the first dielectric member is interposed between the first slot log-periodic antenna portion and the first microstrip log-periodic antenna portion; and wherein a projection of the perimeter of the first microstrip log-periodic antenna portion, perpendicular to the upper surface, and a projection of the perimeter of the first slot log-periodic antenna portion, perpendicular to the lower surface, bound a first impedance gap.

14. The log-periodic antenna of claim 13 wherein the first slot log-periodic antenna portion comprises a plurality of substantially trapezoidal slot dipoles, wherein the slot dipoles are within a ground plane and are substantially transverse to a slot transmission line formed from a slot portion within the ground plane.

15. The log-periodic antenna of claim 13 wherein the first microstrip log-periodic antenna portion comprises a plurality of substantially trapezoidal microstrip dipoles, wherein the microstrip dipoles are substantially transverse to a microstrip transmission line contiguously fixed to the upper surface of the first dielectric member.

16. The log-periodic antenna of claim 15 wherein at least one of the plurality of substantially trapezoidal microstrip dipoles has a slot substantially traversing the microstrip transmission line.

17. A log-periodic antenna comprising:

a substantially planar dielectric substrate having an upper surface and a lower surface;

a first microstrip log-periodic array comprising a plurality of slot dipole elements in a substantially planar arrangement, the first microstrip log-periodic array fixed to the upper surface of the substantially planar dielectric substrate, wherein the plurality of dipole elements includes a base microstrip element;

a first log-periodic slot array within a ground plane comprising a plurality of dipole elements within the ground plane, wherein the ground plane is fixed to the lower surface of the substantially planar dielectric substrate, and wherein the substantially planar dielectric member is interposed between the first log-periodic slot array and the first microstrip log-periodic array, and wherein the plurality of dipole elements includes a base slot element;

a first electrically conductive feed line, contiguously fixed to the upper surface, adapted to transmit to the base microstrip element, wherein the first electrically conductive feed line curvilinearly extends from the base microstrip element; and a first slot transmission line, formed from a slot portion, curvilinearly extending within the ground plane and with decreasing width from the base slot element.

18. The log-periodic antenna of claim 17 wherein the first electrically conductive feed line extends with a tapered transition from the base microstrip element.

19. The log-periodic antenna of claim 17 wherein the width of a projection of a perimeter of the first slot transmission line, perpendicular to the lower surface of the substantially planar dielectric substrate, decreases to a point within a projection of a perimeter of the first electrically conductive feed line, perpendicular to the upper surface of the substantially planar dielectric substrate.

20. A log-periodic antenna array comprising:

a first antenna element having a first phase center travel direction, the first antenna element comprising:

a substantially planar dielectric member having an upper surface and a lower surface;

a first microstrip log-periodic antenna portion mounted to the upper surface of the substantially planar dielectric member, the first microstrip log-periodic antenna portion having a perimeter; and a first slot log-periodic antenna portion mounted to the lower surface of the substantially planar dielectric member;

wherein the substantially planar dielectric member is interposed between the first slot log-periodic antenna portion and the first microstrip log-periodic antenna portion, and wherein a projection of the perimeter of the first microstrip log-periodic antenna portion, perpendicular to the upper surface, and a projection of the perimeter of the first slot log-periodic antenna portion, perpendicular to the lower surface, bound a first impedance gap; and a second antenna element proximate to the first antenna element, the second antenna element having a second phase center travel direction substantially opposite the first phase center travel direction, the second antenna element comprising:

a second microstrip log-periodic antenna portion mounted to the upper surface of the substantially planar dielectric member, the second microstrip log-periodic antenna portion having a perimeter; and a second slot log-periodic antenna portion mounted to the lower surface of the substantially planar dielectric member, and wherein the substantially planar dielectric member is interposed between the second slot log-periodic antenna portion and the second microstrip log-periodic antenna portion, and wherein the second slot log-periodic antenna portion has a perimeter and oriented in proximity to the second microstrip log-periodic antenna portion wherein a projection of the perimeter of the second microstrip log-periodic antenna portion, perpendicular to the upper surface of the substantially planar dielectric member, and a projection of the perimeter of the second slot log-periodic antenna portion, perpendicular to the second surface of the substantially planar dielectric member, bound a second impedance gap; and wherein the second phase center travel direction of the second antenna element is offset from the first phase center travel direction of the first antenna element.

* * * * *